US008733057B2

(12) United States Patent
Seitner

(10) Patent No.: US 8,733,057 B2
(45) Date of Patent: May 27, 2014

(54) BASIC INSULATION COVERING FOR PARQUET AND LAMINATE FLOORS

(75) Inventor: Marco Seitner, Erbes-Büdesheim (DE)

(73) Assignee: Selit Dammtechnik GmbH, Erbes-Budesheim (DE)

( * ) Notice: Subject to any disclaimer, the term of this patent is extended or adjusted under 35 U.S.C. 154(b) by 0 days.

(21) Appl. No.: 12/797,845

(22) Filed: Jun. 10, 2010

(65) Prior Publication Data

US 2011/0146178 A1 Jun. 23, 2011

(30) Foreign Application Priority Data

Dec. 21, 2009 (DE) ..... 20 2009 017 368 U

(51) Int. Cl.
*E04B 2/00* (2006.01)

(52) U.S. Cl.
USPC ..... 52/591.2; 52/177; 52/403.1; 52/590.2

(58) Field of Classification Search
USPC ..... 52/403.1, 390, 590.1, 590.2, 591.1, 52/591.2, 177, 309.4, 392, 589.1; 428/50, 428/20; 472/92
See application file for complete search history.

(56) References Cited

U.S. PATENT DOCUMENTS

| | | | | |
|---|---|---|---|---|
| 3,335,536 | A * | 8/1967 | McCord | 52/410 |
| 3,657,852 | A * | 4/1972 | Worthington et al. | 52/591.3 |
| 4,018,025 | A * | 4/1977 | Collette | 52/302.4 |
| 4,497,858 | A * | 2/1985 | Dupont et al. | 428/44 |
| 4,942,072 | A * | 7/1990 | Chung | 428/48 |
| 5,052,158 | A * | 10/1991 | D'Luzansky | 52/177 |
| 5,108,094 | A * | 4/1992 | Quinn et al. | 482/121 |
| 5,212,842 | A * | 5/1993 | Glydon | 5/420 |
| 5,775,046 | A * | 7/1998 | Fanger et al. | 52/590.1 |
| 5,791,114 | A * | 8/1998 | Mandel | 52/591.3 |
| 6,526,705 | B1 * | 3/2003 | MacDonald | 52/177 |
| 6,588,167 | B2 * | 7/2003 | Chang | 52/590.1 |
| 7,797,890 | B2 * | 9/2010 | Thrush et al. | 52/177 |
| 8,356,447 | B2 * | 1/2013 | Lach | 52/177 |
| 2003/0131549 | A1 * | 7/2003 | Kappeli et al. | 52/390 |
| 2011/0179728 | A1 * | 7/2011 | Cerny et al. | 52/177 |

FOREIGN PATENT DOCUMENTS

| | | | |
|---|---|---|---|
| CN | 201111530 Y | * | 7/2007 |
| DE | 20 2005 017 040 U1 | | 8/2006 |

* cited by examiner

*Primary Examiner* — Brian Glessner
*Assistant Examiner* — Adam Barlow
(74) *Attorney, Agent, or Firm* — Lowe Hauptman & Ham, LLP

(57) ABSTRACT

A basic insulation covering for arrangement between a subfloor and walkable floor coverings that can be laid thereover is described. The arrangement comprising a plug-in connector at at least two sides of the basic insulation covering elements for smooth and expansive connection of the basic insulation covering elements, the plug-in connector having a structured or profiled surface at least in sections on at least one side on borders of the plug-in connector that engage in one another.

18 Claims, 4 Drawing Sheets

BASIC INSULATION COVERING FOR PARQUET AND LAMINATE FLOORS

RELATED APPLICATIONS

The present application is based on, and claims priority from, German Application Number 20 2009 017 368.2, filed Dec. 21, 2009, the disclosure of which is hereby incorporated by reference herein in its entirety.

FIELD

One or more embodiments of the invention relate to a basic insulation covering for arrangement between a subfloor and walkable floor coverings that can be laid thereover, in particular parquet or laminate coverings.

BACKGROUND

It is known to arrange such basic insulation coverings as an intermediate layer between the subfloor, in general cement, and the walkable floor covering arranged thereover, for example a laminate covering, in order to achieve a reduction of sound generation when walking on the floor covering in the room and in particular for rooms that are below and adjacent, and moreover, to cushion the floor covering and thus to increase walking comfort.

In the introduction of the basic insulation coverings, the latter are arranged on the subfloor. In this connection, the basic insulation covering can be rolled out from a roll in, for example, the width of 100 cm and cut to the length of a room. In this connection, several basic insulation covering strips are arranged next to one another to cover the surface of the floor.

In addition, basic insulation covering squares are available that are laid, for example, in the format 80 by 125 cm.

In both cases, in the prior art, these basic insulation coverings are generally laid only loosely on the floor. For connection below one another, it is known to connect to one another the strips of the basic insulation coverings or the squares that are laid on the floor with adhesive tape on the top side and thus to achieve a closed surface. For this purpose, the squares or strips are first arranged next to one another on the subfloor and then are connected at their borders with adhesive tape.

The connection by gluing the borders with adhesive tape is of special relevance if simultaneously with the basic insulation covering, a vapor barrier is to be achieved by a combination with a moisture-proofing film. The moisture-proofing film in this connection is a component of the basic insulation covering, whereby gluing the borders to seal against moisture is necessarily provided.

It is disadvantageous in this procedure, however, that the attachment of the basic insulation covering by means of adhesive tape is expensive, in particular since basic insulation coverings are generally foam coverings with a small thickness of between 1 and 7 mm. These coverings are consequently light, and when handling adhesive tape, movement of the squares or strips with respect to one another can easily occur. Specifically, however, this is problematic in particular in the combination with a vapor barrier, since the basic insulation covering squares or strips are thus no longer snug against one another at their borders and thus form joints that optionally impair or negate the function of the vapor barrier.

In practical use, often no connection at all of the squares or strips below one another is performed if no moisture-proofing is desired. From this result the above-mentioned problems, however, since joints between the squares can develop by a movement of the basic insulation covering during the laying of the walkable floor coverings on the basic insulation coverings.

By the movement of the light basic insulation covering, for example the basic insulation covering squares, joints develop between the basic insulation covering squares, and said joints, on the one hand, form a bridge for sound and thus reduce the desired sound-proofing effect. On the other hand, however, the compressive strength in these areas is also not fully given, since the actual floor covering, for example the laminate covering, does not have any support and can give in the area of these joints.

If an especially heavy load arises specifically in such an area where a joint runs between the basic insulation covering elements below the laminate floor, for example by a heavy piece of furniture being placed there, this can thus result in damage to the floor covering. This threat is especially high if such a joint is arranged between the basic insulation covering elements below an assembly seam of the floor covering elements.

From the publication DE 20 2005 017 040, a basic insulation covering for parquet and laminate floors is known for avoiding these drawbacks, and said covering has a laterally arranged plug-in connector that produces a snug connection of the individual basic insulation covering elements with one another. In this way, it is possible in principle to allow a secure connection between the individual basic insulation covering elements both in conveyor belts and in platforms.

In practice, however, it has turned out that such a shaping is not sufficient by itself to ensure the plug-in connector against an unintentional detachment, in particular when the basic insulation coverings that are used have only a slight thickness. It has thus been shown that in covering thicknesses of 5 mm and less, the basic insulation covering elements that are connected with the plug-in connectors can become detached, especially when the latter are not resting completely flat on the floor based on their forward position in roll form or else in folded strips. The detachment of the plug-in connector and the movement of the basic insulation covering elements that are already arranged on the floor can thus occur, whereby the work is delayed.

SUMMARY

The object of one or more embodiments of this invention is to provide, against this background, basic insulation covering for arrangement between a subfloor and walkable floor covering laid thereover, in particular parquet or laminate coverings, which makes possible a secure connection of the individual basic insulation covering elements even with only slight thicknesses of these elements. In this connection, it is to be ensured that the known plug-in connectors achieve a better hold.

This is achieved according to one or more embodiments of the invention by basic insulation covering elements whose laterally arranged plug-in connectors do not have a smooth outside contour but rather a structured or profiled outside contour.

Because of the surface configuration according to an embodiment of the invention in the area of the borders of the basic insulation covering elements designed as plug-in connectors, smooth borders no longer adjoin as in known designs, but rather the borders of the plug-in connectors that are opposite one another have different structures or profiles, which lead to increased friction, for example owing to tilting of the different surface structures with respect to one another.

In the detailed examination, various types of tilting emerge from these variously structured borders. There are areas where the foam material is pressed together because of two projecting structural elements, and it thus results in increased friction by the material compression at this point. At other points, minor projections engage in offset recesses, by which deformations result within this area that also produce a tilting and an increase in friction between these borders.

In this connection, different types of structures or profiles of the borders are suitable. In principle, a one-sided or two-sided structuring is possible, i.e., only one border of the plug-in connector can have a structuring and engage in one of the opposing square plug-in connector borders, or both opposing borders can have a structure or profile.

When basic insulation covering squares are used, the connectors according to an embodiment of the invention are arranged circumferentially on the four edges of each basic insulation covering square in order to make possible a smooth connection of the individual basic insulation covering squares for covering the entire surface of the floor. In this connection, in each case a plug-in lug is arranged facing a connector receptacle, and thus the basic insulation covering squares can be connected to a flat surface by interconnecting this connector.

If the basic insulation covering is rolled off from a roll in strips and cut, the covering according to an embodiment of the invention has the above-mentioned connector on its two longitudinal edges that form the borders.

In principle, the basic idea of one or more embodiments of the invention is to replace the previous adjuvant for connecting the elements by a special shaping of the borders, which ensures secure holding by the borders that are structured according to the invention. It is therefore of lesser importance how the plug-in lugs and receptacles that engage in one another are formed and at what frequency the latter are arranged at the edges that are to be connected.

Configuring plug-in lugs and receptacles in a trapezoidal shape has proven to be a suitable design since good interlocking of the connecting elements is thus achieved. Other shapings are also possible, however. It is advantageous in this connection that in each case a receptacle is arranged between the adjacent plug-in lugs and is formed by the latter.

In particular, in a first step, the application in connection with an integrated moisture-proofing film makes possible the laying and plugging-together of the basic insulation covering elements over a large area in order to then seal and to attach in a second step the borders that are interlocked with an adhesive tape on the top.

BRIEF DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION OF THE DRAWINGS

Figure 1:
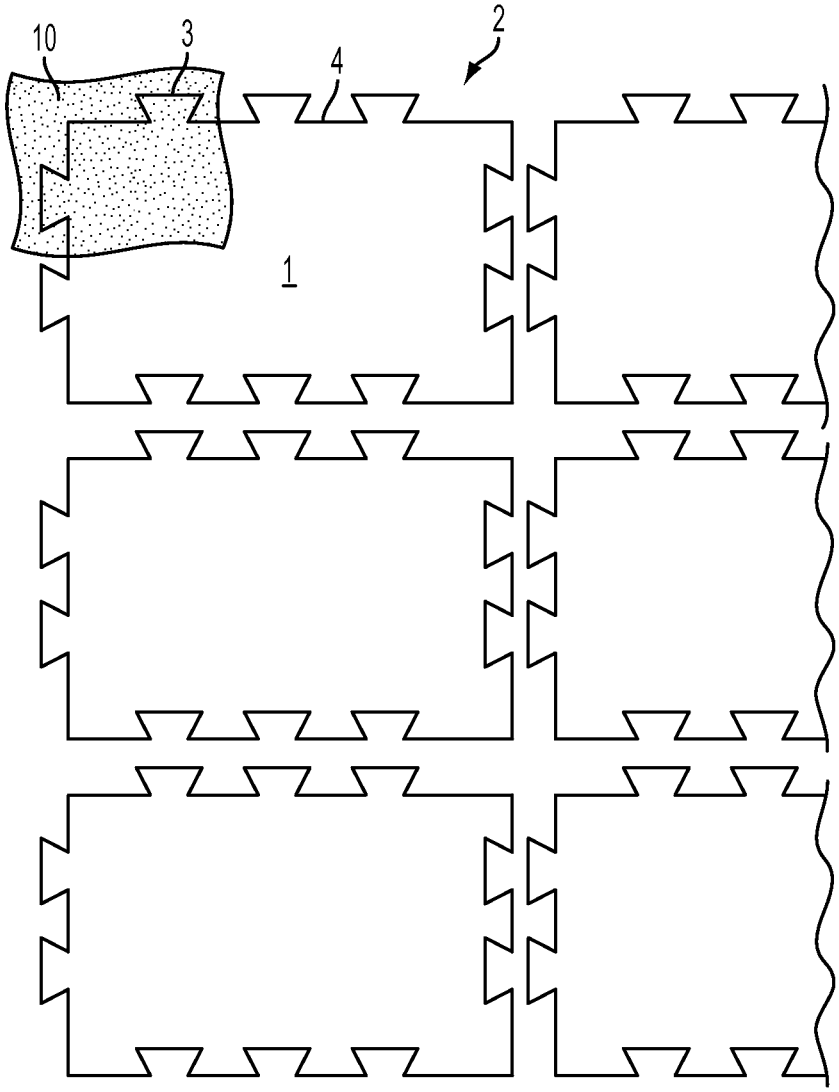
FIG. 1 shows a number of basic insulation covering squares 1 with plug-in connectors.
Figure 2:
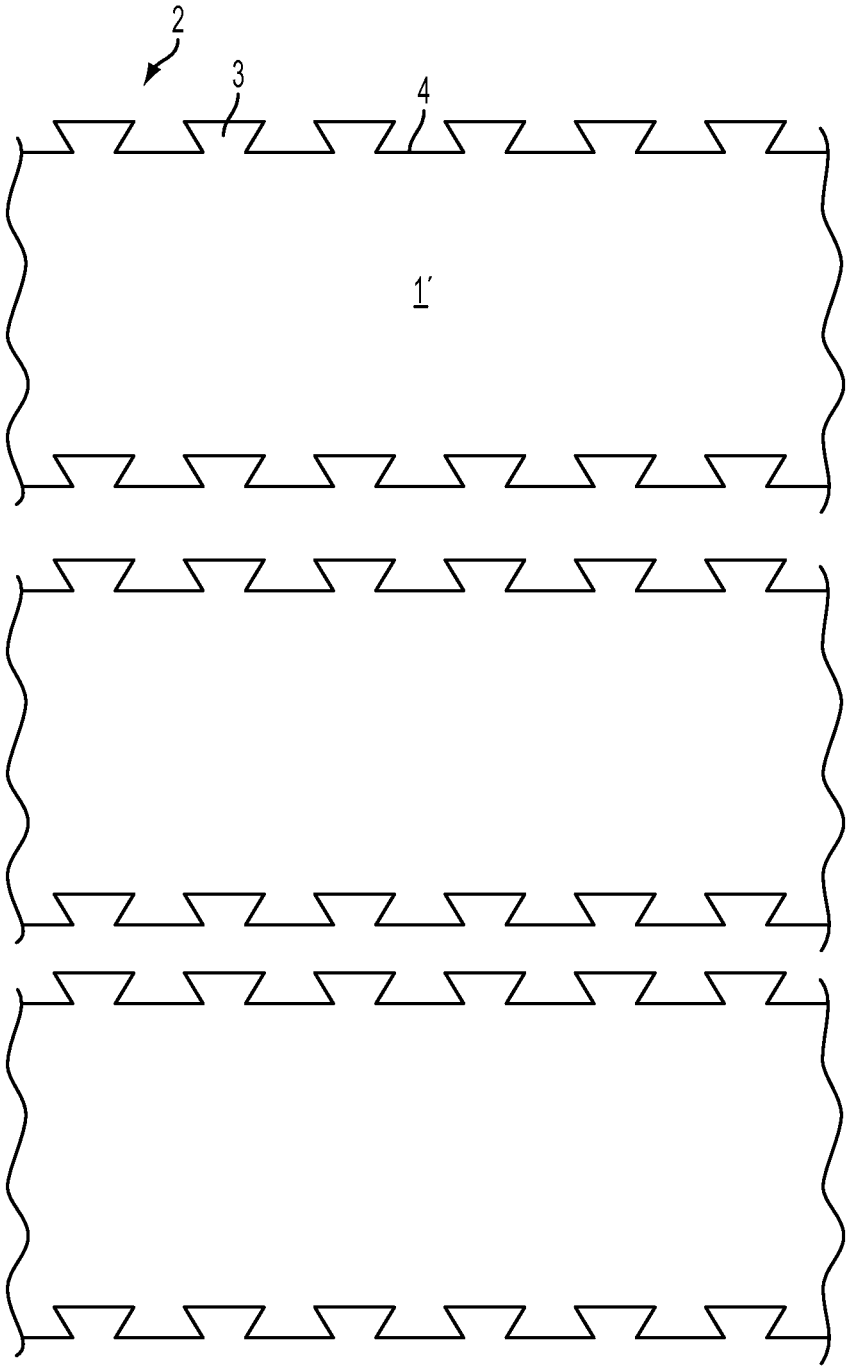
FIG. 2 shows three basic insulation covering strips 1' with lateral plug-in connectors that are arranged in parallel.

FIGS. 1 and 2 show diagrammatically and in cutaway how a surface of basic insulation covering elements 1, 1' that covers the subfloor can be assembled according to one or more embodiments of the invention. A walkable floor covering 10 is over the surface of basic insulation covering element 1. In this connection, in both figures, the plug-in connector is not yet assembled for better illustration.

In FIG. 1, basic insulation covering squares 1 are shown that have a circumferential plug-in connector, by which the individual elements can be assembled like a puzzle on a surface.

In FIG. 2, there are strips that are cut to the length of the respective room and therefore have only lateral plug-in connectors.

Figure 3:
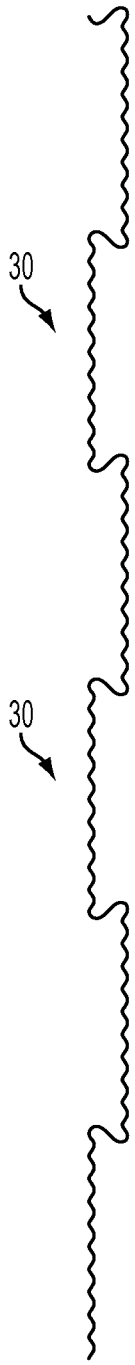
FIG. 3 shows an example of an embodiment of the plug-in connector with profiled borders.

FIG. 3 shows in segments the profile of the lateral borders of the plug-in connectors in one example. FIG. 3 includes a saw-tooth serration 30 along an edge of the lugs and the receptacles. Neither the design of the plug-in connector nor the shape of the profile is to be a final indication in this case, but rather is only an example of a number of possible structural design options.

It is readily recognizable that the outside contour of the plug-in connector in this case does not run smoothly as is shown in simplified form in FIGS. 1 and 2; rather a type of serrated contour can be seen that ensures that the connecting elements that are plugged into one another hold together better.

Figure 4:
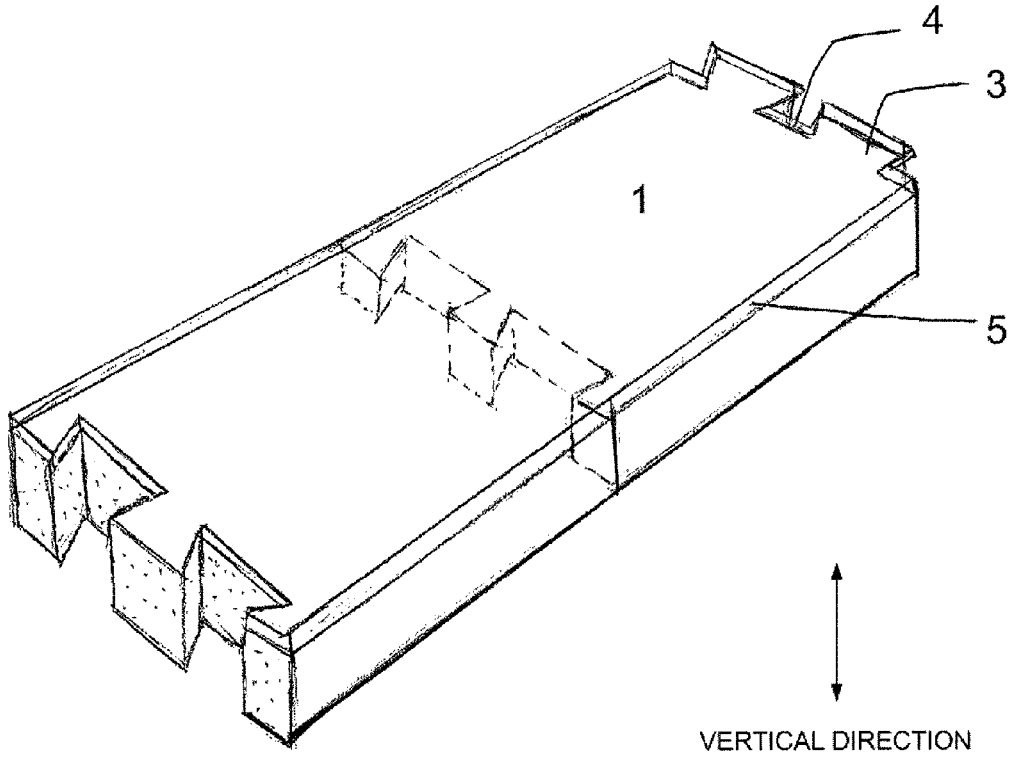
FIG. 4 shows a perspective view of an example of an embodiment of the plug-in connector with a moisture proof barrier.

FIG. 4 shows a perspective view of basic insulation covering squares 1 with a moisture proof barrier 5. Moisture proof barrier 5 is rigidly connected to basic insulation covering squares 1. Basic insulation covering squares comprise foamed plastic. A serrated-like structuring of the borders of the plug-in connector runs approximately vertically to a support surface of the basic insulation covering squares 1.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon by limited only by the definition contained in the appended claims and equivalents thereof.

The invention claimed is:

1. A basic insulation covering for arrangement in a horizontal direction between a subfloor and walkable floor coverings that can be laid thereover, comprising:

at least two basic insulation covering elements, wherein each of the basic insulation covering elements has a plug-in connector at at least two sides connection with the other of the basic insulation covering elements, wherein a thickness of at least one of the at least two basic insulation covering elements ranges from 1 to 7 millimeters (mm), wherein the plug-in connector includes a plurality of lugs and receptacles alternatingly arranged along borders of said at least two sides, the lugs of one of the basic insulation covering elements being engageable in corresponding receptacles of the other basic insulation covering element, and wherein a surface of each of the plurality of lugs configured to engage with the corresponding receptacles comprises a first saw-tooth serration.

2. The basic insulation covering according to claim 1, wherein a surface of the corresponding receptacle configured to engage with the lugs comprises a second saw-tooth serration.

3. The basic insulation covering according to claim 2, wherein the second saw-tooth serration structuring of the borders of the plug-in connector runs approximately vertically to a support surface of the basic insulation covering elements.

4. The basic insulation covering according to claim 1, an interlocking of the basic insulation covering elements being arranged on the borders.

5. The basic insulation covering according to claim 1, wherein the plug-in connector is formed from trapezoidal receptacles and plug-in lugs, which are arranged alternately and mirror-inverted to one another on the borders.

6. The basic insulation covering according to claim 1, wherein in each case, a receptacle is formed from the intermediate area of two plug-in lugs of the plurality of lugs.

7. The basic insulation covering according to claim 1, wherein the plug-in connectors are arranged circumferentially on four borders of a basic insulation covering square.

8. The basic insulation covering according to claim 1, wherein the plug-in connectors are arranged on two borders of a basic insulation covering strip.

9. The basic insulation covering according to claim 1, wherein the basic insulation covering is rigidly connected to a moisture-proofing film.

10. The basic insulation covering according to claim 1, wherein the basic insulation covering comprises a foamed plastic.

11. A floor covering for arrangement in a horizontal direction over a subfloor, comprising:

a basic insulation covering element having a plug-in connector arranged at at least two sides, the basic insulation covering element for arrangement over a subfloor, and a walkable floor covering arranged over the basic insulation covering element, wherein the plug-in connector includes a plurality of lugs and receptacles alternatingly arranged along borders of said at least two sides, and wherein a surface of each of the plurality of lugs configured to engage with a corresponding receptacle comprises a first saw-tooth serration.

12. A basic insulation covering for arrangement in a horizontal direction between a subfloor and walkable floor coverings, comprising:

a basic insulation covering element having a plug-in connector arranged at at least two sides, wherein a thickness of the basic insulation covering element ranges from 1 to 7 millimeters (mm), wherein the plug-in connector includes a plurality of lugs and receptacles alternatingly arranged along borders of said at least two sides, wherein the plurality of lugs projects outwardly in the horizontal direction of the basic insulation covering element, and wherein a surface of each of the plurality of lugs configured to engage with a corresponding receptacle comprises a first saw-tooth serration.

13. The basic insulation covering according to claim 11, wherein a surface of the corresponding receptacle configured to engage with the lugs comprises a second saw-tooth serration.

14. The basic insulation covering according to claim 12, wherein a surface of the corresponding receptacle configured to engage with the lugs comprises a second saw-tooth serration.

15. The floor covering according to claim 11, wherein the basic insulation covering element has a plug-in connector arranged at only two sides.

16. The basic insulation covering according to claim 12, wherein the basic insulation covering element has a plug-in connector arranged at only two sides.

17. The basic insulation covering according to claim 1, wherein the thickness of the basic insulation covering element ranges from 1 to 5 mm.

18. The basic insulation covering according to claim 12, wherein the thickness of the basic insulation covering element ranges from 1 to 5 mm.

* * * * *